United States Patent [19]

Hurley

[11] 4,120,441

[45] Oct. 17, 1978

[54] ANGLE EDGE GUARD

[76] Inventor: Richard D. Hurley, 3210 NW. McKinley Dr., Corvallis, Oreg. 97330

[21] Appl. No.: 791,128

[22] Filed: Apr. 25, 1977

Related U.S. Application Data

[63] Continuation of Ser. No. 656,571, Feb. 9, 1976, abandoned.

[51] Int. Cl.[2] ..... B65D 5/00

[52] U.S. Cl. ..... 206/586; 206/453; 217/69; 229/DIG. 1

[58] Field of Search ..... 229/14 C, 2.5 F C; 206/521, 453; 217/66, 67, 69

[56] References Cited

U.S. PATENT DOCUMENTS

| | | | |
|---|---|---|---|
| 1,356,391 | 10/1920 | Myers | 217/69 |
| 1,876,063 | 9/1932 | Kronenberger | 229/DIG. 4 |
| 2,266,181 | 12/1941 | Epps | 206/453 |
| 2,655,303 | 10/1953 | Cox | 229/2.5 EC |
| 3,023,885 | 3/1962 | Kindseth | 229/14 C X |
| 3,030,728 | 4/1962 | Wesman | 229/14 C X |
| 3,152,693 | 10/1964 | Anderson | 217/69 X |
| 3,645,387 | 2/1972 | Hunt | 206/453 |
| 3,762,626 | 10/1973 | Dorsey | 229/14 C |
| 3,854,529 | 12/1974 | Scharre | 206/521 X |

*Primary Examiner*—Davis T. Moorhead

*Attorney, Agent, or Firm*—Klarquist, Sparkman, Campbell, Leigh, Hall & Whinston

[57] ABSTRACT

An angle edge guard for interposition between the interior of a shipping container and the exterior of an object being shipped is formed of two molded pulp walls having first edges joined to dispose the walls in substantially 90° relation when in place. The walls are indented at intervals up to a non-indented common ridge where the two walls join, leaving non-indented face ridges. The indentations form inwardly directed ribs defining therebetween a plurality of grooves including a deep corner groove in juxtaposition with the common ridge and side grooves in juxtaposition with the aforementioned face ridges and communicating with the corner groove.

4 Claims, 4 Drawing Figures

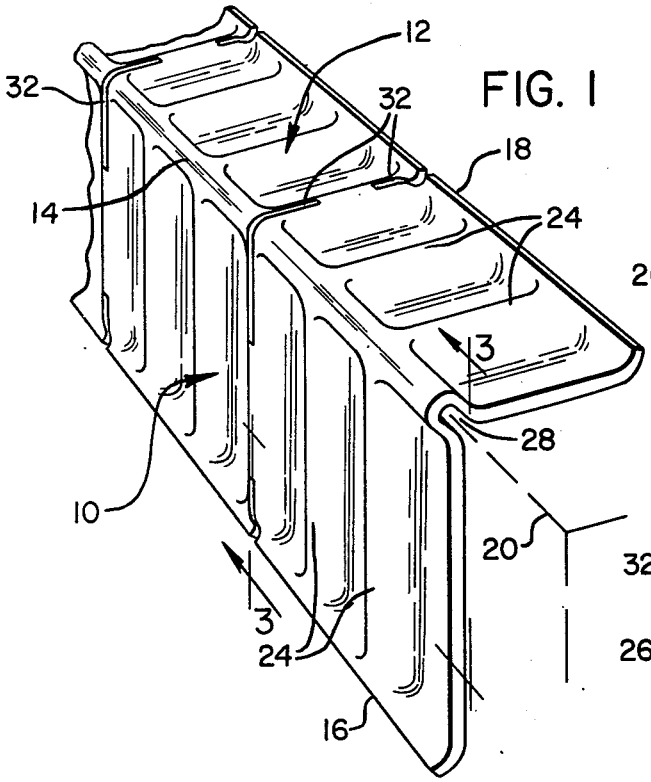
FIG. 1
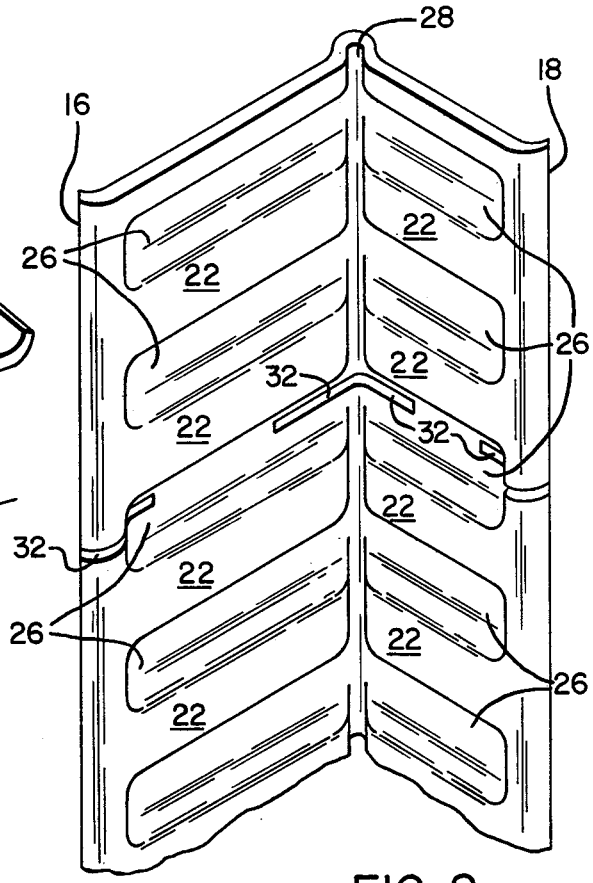
FIG. 2
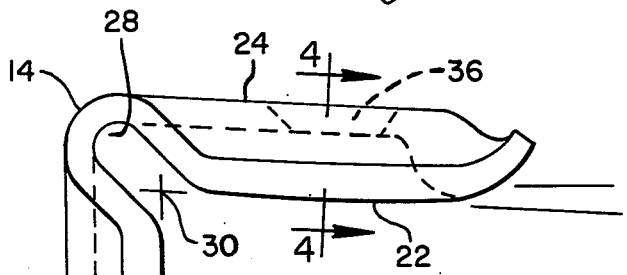
FIG. 3
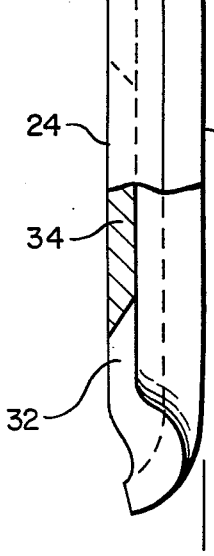
FIG. 4
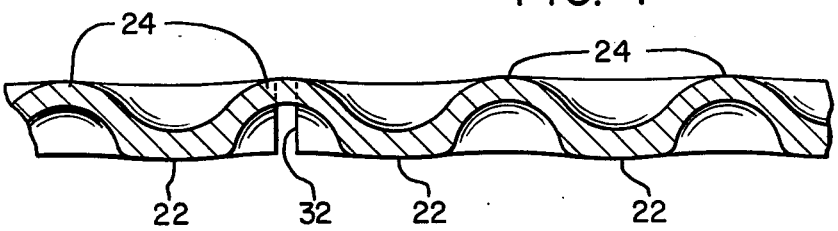

ANGLE EDGE GUARD

This is a continuation of application Ser. No. 656,571, filed Feb. 9, 1976, now abandoned.

BACKGROUND OF THE INVENTION

Protective means are frequently employed between shipping cartons and objects being shipped therewithin, such protective means in some cases required by shipping regulations. For instance, corrugated paper, folded at the edges of the object being shipped, has been employed heretofore for spacing an object such as a piece of furniture from the inside of its shipping carton. The folded article thus formed is designed to absorb shock while at the same time reasonably securely positioning the item of furniture or other object within the carton.

The corrugated means heretofore employed have either consisted of hand-folded, corrugated sheets of material, built up and folded along scored lines to provide a shipping protector, or in other instances have comprised prefolded laminated, glued strips. Of course, the hand folded construction requires considerable labor in the actual separate hand manufacture of each protector. Also, either the multiple laminated or hand-folded device may require appreciable material and moreover the material will come into contact with the edge of the furniture or article being shipped whereby a sharp blow can cause undesired damage to such edge, or such direct contact may cause abrasion to the finish of the article during shipment. Styrofoam edge guards have also been employed. However, these devices tend to be more expensive, and often fail after sustaining a sharp blow.

SUMMARY OF THE INVENTION

According to the present invention, a unitary angle edge guard protector comprises a pair of generally flat, molded pulp walls having first edges joined, said walls being indented at intervals from second edges substantially up to the joined first edges forming a plurality of inwardly directed flat faces ribs while leaving a non-indented common ridge where the walls meet and non-indented face ridges located between the ribs. The inwardly directed ribs define therebetween a plurality of grooves on the interior of the protector including a deep corner groove in juxtaposition with the common ridge and side grooves in juxtaposition with the face ridges and communicating with the corner groove. The faces of the inwardly directed ribs for each wall substantially define a plane, the corner groove being deeper than the intersection of the planes of the faces of the inwardly directed ribs of the two walls such that no contact is made with the angle edge of the object being shipped.

The construction according to the present invention provides advantageous engagement, cushioning and protection of the object being shipped while at the same time maintaining strength and resistance to pressure. The rib construction provides advantageous conforming contact with the object being shipped and shock resistant support in a strong, light, inexpensive device.

It is accordingly an object of the present invention to provide an improved angle edge guard for use in shipping cartons and the like.

It is a further object of the present invention to provide an improved angle edge guard characterized by enhanced protection and resilient cushioning of the object being shipped while at the same time preserving strength against crushing or inadequate support of the shipped article.

It is another object of the present invention to provide an improved angle edge guard for use in shipping which is economical of material and manufacturing time.

It is another object of the present invention to provide an improved angle edge guard which makes substantially no contact with the angle edge of the article being shipped.

The subject matter which I regard as my invention is particularly pointed out and distinctly claimed in the concluding portion of this specification. The invention, however, both as to organization and method of operation, together with further advantages and objects thereof, may best be understood by reference to the following description taken in conjunction with the accompanying drawings wherein like reference characters refer to like elements.

DRAWINGS

FIG. 1 is a perspective view, partially broken away, illustrating an angle edge guard according to the present invention in its normal use position;

FIG. 2 is an inside perspective view, partially broken away of a FIG. 1 angle edge guard;

FIG. 3 is a transverse end and cross-sectional view taken at 3—3 of FIG. 1; and FIG. 4 is a vertical cross-section view; partially broken away, taken at 4—4 in FIG. 3.

DESCRIPTION OF THE PREFERRED EMBODIMENT

Referring to the drawings, an angle edge guard according to the present invention is formed from cellulose pulp material in one piece and includes a pair of walls 10 and 12 having first edges joined at a common ridge 14, and second edges 16, 18 spaced from said first edges and generally parallel to said first edges. The first wall 10 has a width between its first and second edges which is on the order of twice the width between the first and second edges of wall 12. E.G., the width of wall 10 may be aproximately 4" while the width of wall 12 may be approximately 2½"as measured between point 30 (FIG. 3) and the second wall edges.

In FIG. 1, the angle edge guard is illustrated in position along the edge 20 of an object being shipped, i.e., between such object and the interior corner of a shipping container or the like. In this stressed condition, the walls make an angle of 90° with one another for matching the generally 90° configuration of the object being shipped. However, in the newly formed or free state of the articles the walls are designed to make an angle with one another of slightly less than 90° as illustrated in FIG. 3, whereby the object being shipped will be firmly grasped therebetween in the stressed condition of the edge guard when employed as illustrated in FIG. 1.

The walls are indented, at intervals, from said second edges substantially up to said first edges, providing a plurality of inwardly directed flat faced ribs 22, while leaving a non-indented common ridge 14 where the walls meet. The inwardly directed flat faced ribs also leave non-indented face ridges 24 therebetween which extend from the second edges of the walls up to and joined to the common ridge 14. The ribs 22 as well as the ridges therebetween are suitably in substantially perpendicular relation to the common ridge and to the second edges.

The ribs are enlarged slightly to provide flat inner pads or faces which are in a plane substantially parallel to the wall in each case for directly abutting the corresponding face of the object being shipped. The exterior ridge construction 24, 14, together with the second edges provide appreciable strength in the form of the structure, while the indented structure as thus formed is also resistant to crushing in a direction perpendicular to the wall, thereby providing inherent protective qualities.

From the interior of the article, the inwardly directed ribs 22 define therebetween a plurality of grooves 26 extending substantially normally from the second wall edges and communicating with a deep corner groove 28. The grooves 26 are in juxtaposition with the aforementioned exterior ridges 24, while the deep corner groove is in juxtaposition with the non-indented common ridge 14 defining first edges of the walls.

The planes of ribs 22 intersect at a point 30 (in FIG. 3) well short of the depth of deep corner groove 28. In other words, the corner groove is deep enough so that the edge of a piece of furniture with straight walls would not reach bottom of the groove. Typically, the indentation is such as to provide a $\frac{5}{8}$ inch clearance between the object being shipped and the bottom of groove 28. This clearance is illustrated in position at edge 20 in FIG. 1. The height of ridges 24 and 14 provide the clearance.

At intervals along the respective walls are provided tear slots 32 by means of which an extended angle edge guard may be separated or severed into separate pieces or sections. These tear slots are desirably positioned along grooves 26 and ridges 24 at intervals, e.g., every 5 or 6 inches. The slots are segmentally intermittent in cross-section as illustrated in FIG. 3, leaving holding webs 34 and 36 in the respective walls, allowing the edge guards to be torn apart manually into sections as desired. Placement of the tear slots at the bottoms of grooves 26 eliminates any possible distortion as might occur along the face of the object being shipped, were the tear slots to be disposed along the flat faced ribs 22.

The ribs are separated from one another by grooves 22 completely up to the corner groove 28 on the interior of the edge guard to provide a plurality of substantially independent, full height pads for smoothly engaging the side of the piece of furniture or other object being shipped. The separated, flat-faced ribs provide appreciable bearing surface and better conformity with the article being shipped than would be the case with a single indented surface. Also, better cushioning and shock absorption is afforded than in the case of non-separated ribs. The flat faces of the ribs are sufficiently wide (e.g., being approximately 1 and $\frac{1}{8}$" to 1 and $\frac{3}{8}$" in width in the direction of the length of the overall article) to provide appreciable flat surface in contact with the article being shipped with minimization of possible "printing" on the surface of the article being shipped. The second edges 16 and 18 are relieved away from the planes of ribs 22 so as to prevent any improper indentation as might otherwise occur upon the shipped object.

The angle edge guard protector according to the present invention is of nearly uniform wall thickness, e.g., a nominal $\frac{1}{4}$" wall thickness in a specific example and represents a savings in material and time of manufacture as compared with products of non-uniform thickness wherein the period of time for the article to dry during manufacture might become excessive. A $\frac{5}{8}$" overall thickness is, however, provided in such example as a result of the ribbed construction. The article according to the present invention, due to its construction, attains appreciable strength while utilizing a minimum of material and a practical or competitive manufacturing process.

The article according to the present invention is suitably formed from repulped cellulose material derived from any waste paper having fairly long fibers, such as corrugated boxes, bags, egg cartons or the like, or a mixture of fibrous material for insuring resilient, strong construction. The raw material is repulped in a pulper or beater which separates the fibers in water while paper-making chemicals such as alum and rosin may be added for subsequetly adhering the fibers together. Water is added to bring the mixture to about 98° water and 2% fiber. The repulped cellulose material is suitably vacuum formed in a usual manner between a pair of dies of mating construction and dried to the article herein described and illustrated.

In use, the shorter wall is suitably placed in the top and horizontal position over an article being shipped, and the long wall 10 is vertically disposed. This position provides added stability for mantaining positioning of the angle edge guard as when a shipping carton is turned over to seal the bottom thereof. When a top sealed carton is turned over roughly on a high-speed packing line, the furniture therewithin may actually bounce within the carton allowing the angle edge guards to slip out of position if added length is not given to the wall 10. Of course, the orientation of the wall may be reversed to provide more horizontal surface protection as in the case of furniture packed with angle edge guards on both top and bottom, for example, in the case of chests and the like without legs. On items handled "on end" by hand carts, the longer wall may be placed in a manner best to eliminate the possibility of damage due to "prying" by the hand cart.

While I have shown and described a preferred embodiment of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. A unitary angle edge guard protector adapted for interposition between a substantially ninety degree interior corner of a shipping container and the exterior angle edge of an object being shipped, comprising:

(a) a pair of generally flat molded pulp walls;

(b) said walls being integrally joined by an arcuate portion and being in substantially ninety degree relation to one another when in place between said interior corner of a shipping container and a said exterior angle edge of an object being shipped;

(c) each of said walls having an outwardly facing surface;

(d) each of said walls having outwardly facing elongate leading edges;

(e) each of said outwardly facing surface of said walls having a plurality of outwardly facing indentations at spaced intervals from a predetermined distance from said leading edge and a predetermined distance from said arcuate portion and normal to said leading edges;

(f) said arcuate portion defining an inwardly facing elongate groove between said inwardly facing surface of said walls;

(g) each of said inwardly facing surface of said walls having a plurality of inwardly facing indentations normal to said leading edges at spaced interals from a predetermined distance from said leading edge to said arcuate portion and integral with said elongate groove;

(h) said inwardly facing indentations being joined by relatively flat planar surfaces and said planar surfaces being oppositely disposed to said outwardly facing indentations;

(i) said outwardly facing indentations being joined by substantially rounded web surfaces and said rounded web surfaces being oppositely disposed to said inwardly facing indentations;

(j) said walls including an angle of less than ninety degrees in a free, non-stressed condition, said walls being relatively movable around said elongate groove from the non-stressed condition to the ninety degree condition.

2. The angle edge guard according to claim 1 wherein said leading edges are bevelled upwardly and outwardly.

3. The angle edge guard according to claim 1 wherein said leading edges are substantially parallel to said elongate groove with the width of one of said walls being on the order of twice as wide between its first and second edges as the other of said walls.

4. The angle edge guard according to claim 1 wherein said walls are provided with tear slots at intervals therealong wherein a tear slot in one of said walls forms an aligned continuation of a tear slot in the other of said walls to permit the severing of said angle edge guard into sections.

* * * * *